US005611081A

United States Patent [19]

Torres

[11] Patent Number: 5,611,081

[45] Date of Patent: Mar. 18, 1997

[54] WORK PANTS WITH KNEE AND SHIN PROTECTORS

[76] Inventor: Al Torres, 2047 Montrose Ave., Montrose, Calif. 91020

[21] Appl. No.: 503,397

[22] Filed: Jul. 17, 1995

[51] Int. Cl.[6] ..... A41D 13/00

[52] U.S. Cl. ..... 2/23; 2/227

[58] Field of Search ..... 2/22, 23, 24, 62, 2/227

[56] References Cited

U.S. PATENT DOCUMENTS

| | | | |
|---|---|---|---|
| 2,355,193 | 8/1944 | Walker | 2/23 X |
| 2,568,083 | 9/1951 | Mitchell . | |
| 3,168,746 | 2/1965 | Smith | 2/24 |
| 3,346,877 | 10/1967 | Zirves . | |
| 3,670,339 | 6/1972 | Cooper et al. | 2/24 X |
| 4,561,123 | 12/1985 | Hull | 2/23 |
| 4,561,124 | 12/1985 | Thompson | 2/23 |
| 4,831,666 | 5/1989 | Denman | 2/23 |
| 4,920,577 | 5/1990 | Scharf | 2/24 |

FOREIGN PATENT DOCUMENTS

| | | | |
|---|---|---|---|
| 2199233 | 7/1988 | United Kingdom | 2/23 |

*Primary Examiner*—Paul C. Lewis
*Attorney, Agent, or Firm*—J. E. Brunton

[57] ABSTRACT

An improved work pants construction in which padding is provided to protect both the knees and shins of the worker. In one form of the invention, the knee protective padding and the shin protective padding comprise separate components which are independently receivable within specially configured pockets provided in the work pants. More particularly, the knee protective padding is receivable within a top opening pocket in the work pants while the shin protective padding is receivable within a bottom opening pocket provided in the work pants.

13 Claims, 3 Drawing Sheets

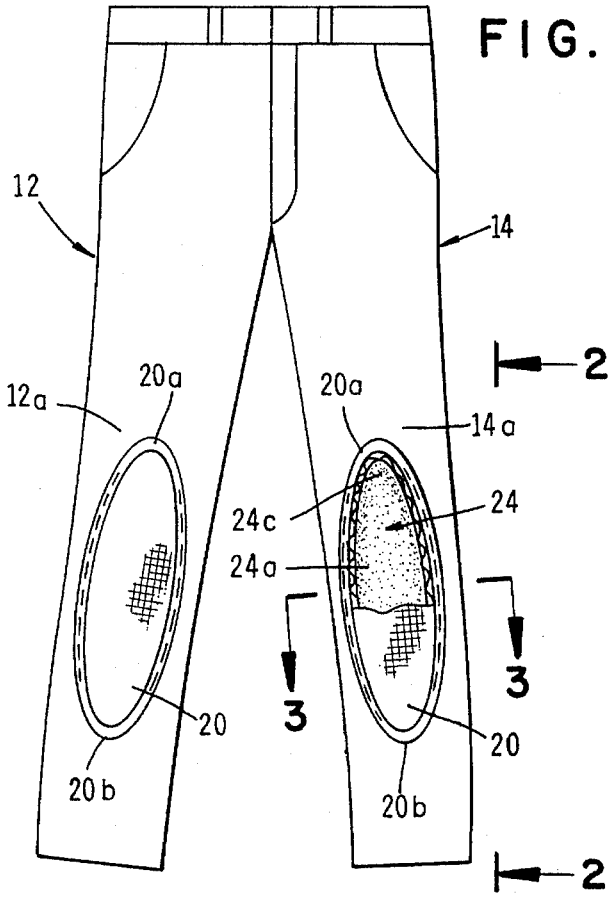
FIG. 1
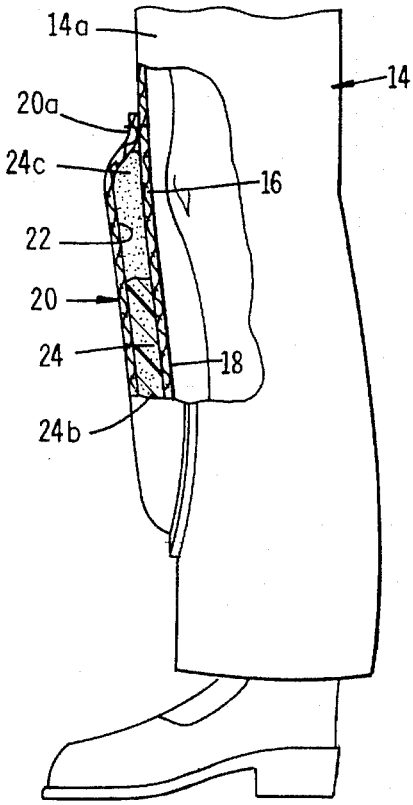
FIG. 2
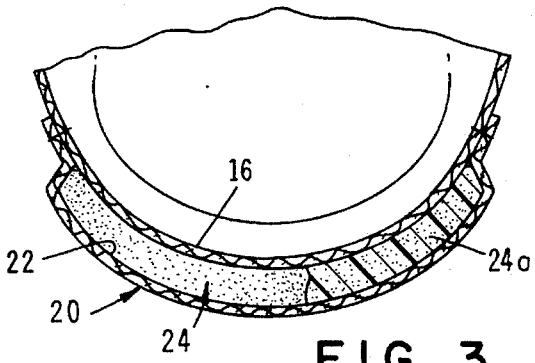
FIG. 3
FIG. 4
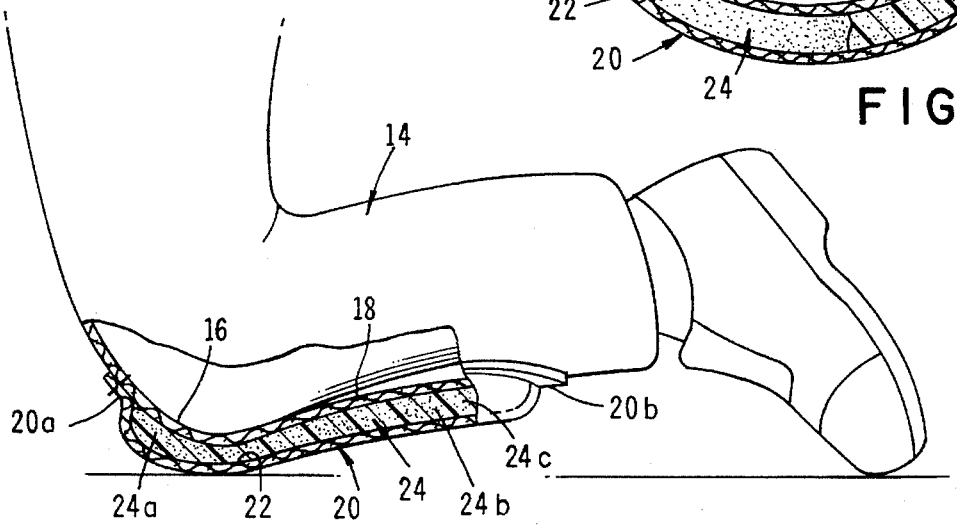

WORK PANTS WITH KNEE AND SHIN PROTECTORS

BACKGROUND OF THE INVENTION

1. Field of the Invention

The present invention relates generally to padded work pants. More particularly, the invention concerns work pants having removable padding for protecting the knees and shins of the user.

2. Discussion of the Invention

Padded knee protectors have long been used by workers to cushion and protect their knees. For example, carpenters, roofers, floor tilers and gardeners spend considerable time in a kneeling position and, for purposes of comfort and safety require protection for the knees.

A number of garment designs embodying knee protectors have been suggested. For example, U.S. Pat. No. 4,831,666 issued to Denman describes a garment that is especially adapted for protecting the knees while gardening. Similarly, U.S. Pat. No. 4,561,124 issued to Thompson discloses a knee protector for insertion in a pocket in the legs of work pants wherein the knee protector is of a V-shaped cross section. In U.S. Pat. No. 4,920,577 issued to Sharf, a pair of work pants is described which comprises two legs joined together at a crotch area and a protective layer secured to the front of each leg having an upper edge no lower than the crotch area and a lower edge below the knee area. Each protective layer is secured to the underlying material in a manner to define a pocket in which a padding member can be removably inserted. In a somewhat similar vein, U.S. Pat. No. 2,568,083 issued to Mitchell discloses work pants which are so constructed that removable knee pads can be quickly installed and removed.

In addition to the prior art constructions described in the preceding paragraph, a number of knee pad constructions have been suggested which can be strapped or otherwise affixed over the work pants themselves to protect the worker's knees. Exemplary of these types of devices are those described in U.S. Pat. No. 4,561,123 issued to Hull and U.S. Pat. No. 3,346,877 issued to Zirves.

While the prior art knee pad structures generally perform in a satisfactory manner, many of the constructions are bulky, uncomfortable and inconvenient to use, and substantially detract from the appearance of the work garments. Further, while the prior art patents provide a number of constructions adapted to protect the user's knees, applicant is unaware of any prior art structure that protects both the knee and shin of a worker. In a great number of different occupations, it is desirable to protect both the knees and the shins of the worker. For example, steel workers, riggers, miners and luggage handlers are exemplary of but a few such occupations.

The work pants of the present invention uniquely overcome the drawbacks of prior art work pants construction by providing for the first time a work pant construction wherein pads are provided to protect both the knees and shins of the user. In one embodiment of the invention, the knee pads and shin protectors comprise separate elements which can be used simultaneously or, alternatively, can be used one at a time. In this latter form of the invention, the knee pads are insertable within a top opening pocket formed in the knee area of the work pants while the shin protector is receivable into a bottom opening pocket provided in the work garment. Due to the novel construction of both the knee pads and shin pads, the appearance of the work garment is substantially improved by avoiding the substantial distortion in the shape of the work pants as is caused by the prior art protective padding.

SUMMARY OF THE INVENTION

It is an object of the present invention to provide improved work pants which are particularly useful in a number of different occupations wherein both the knees and shins of the worker require protection against injury.

Another object of the invention is to provide work pants of the aforementioned character in which the knee and shin padding is uniquely shaped so as to not detract from the appearance of the garment.

Another object of the invention is to provide work pants of the character described in the preceding paragraphs in which the knee protective padding and the shin protective padding is removably received within uniquely shaped pockets formed in the work pants.

Another object of the invention is to provide work pants of the character described in which the knee pad and the shin pad comprise separate components which are independently received within specially configured pockets provided in the work pants. More particularly, in one form of the invention, the knee protective padding is receivable within a top opening pocket in the work pants while the shin protective padding is receivable within a bottom opening pocket provided in the work pants.

Yet another object of the invention is to provide a protective garment of the class described which is easy to use, is durable in use and yet can be inexpensively manufactured.

BRIEF DESCRIPTION OF THE DRAWINGS

FIG. 1 is a front view of one form of the work pants construction of the present invention.

FIG. 2 is an enlarged view partly in cross section taken along lines 2—2 to FIG. 1.

FIG. 3 is an enlarged, cross-sectional view taken along lines 3—3 of FIG. 1.

FIG. 4 is a generally diagrammatic view illustrating the configuration of the knee pad protector of the invention when the worker is in a kneeling position.

DESCRIPTION OF THE INVENTION

Figure 5:
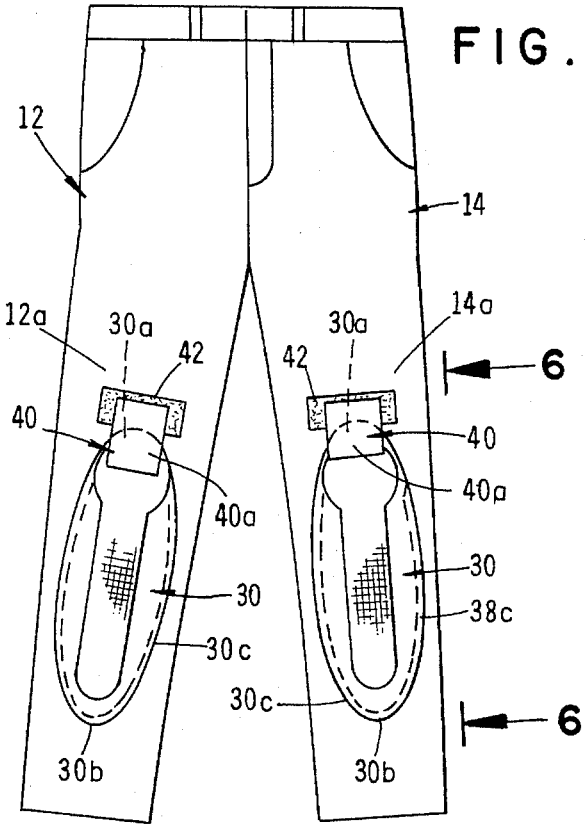
FIG. 5 is a front view of another embodiment of the work pants construction of the present invention.

Referring to the drawings and particularly to FIGS. 1 through 4, one form of the work pants construction of the present invention is there illustrated. The work pants here comprise a pair of interconnected leg portions 12 and 14 each of which includes a front panel 12*a* and 14*a* respectively. As best seen in FIG. 4, each front panel includes a knee covering portion 16 and a shin covering portion 18.

A protective layer 20 is connected to the front panel of each leg and includes an upper edge 20*a* located above knee covering portion 16 and a lower edge 20*b* located below the shin covering portion 18 of the front panel. Protective coating 20 is interconnected with the front panel of each leg portion by any suitable means such as sewing to form a pocket having an interior space 22. As best seen by referring to FIGS. 2 and 4, the pockets define an interior space 22 that extends slightly above the knee portion and slightly below the shin portion of the wearer.

Contained within each interior space or compartment 22 of the pockets is a padding generally designated in FIGS. 1 through 5 by the numeral 24. Padding 24 includes a knee covering portion 24*a* and shin covering portion 24*b*. Knee covering portion 24*a* is of a first width and has an upper edge portion 24*c* disposed proximate the upper edge 20*a* of protective layer 20. Shin covering portion 24*b* is of a second lesser width and has a lower edge portion 24*c* disposed proximate the lower edge 20*b* of protective layer 20.

Turning now to FIGS. 5 through 9, an alternate form of the work pants construction of the present invention is there illustrated. This form of the invention is similar in many respects to that shown in FIGS. 1 through 4 and like numerals have been used to identify like components.

As before, the work pants comprise a pair of interconnected leg portions 12 and 14 each of which includes a front panel 12*a* and 14*a* respectively. Each front panel includes a knee covering portion 16 and a shin covering portion 18.

Figure 6:
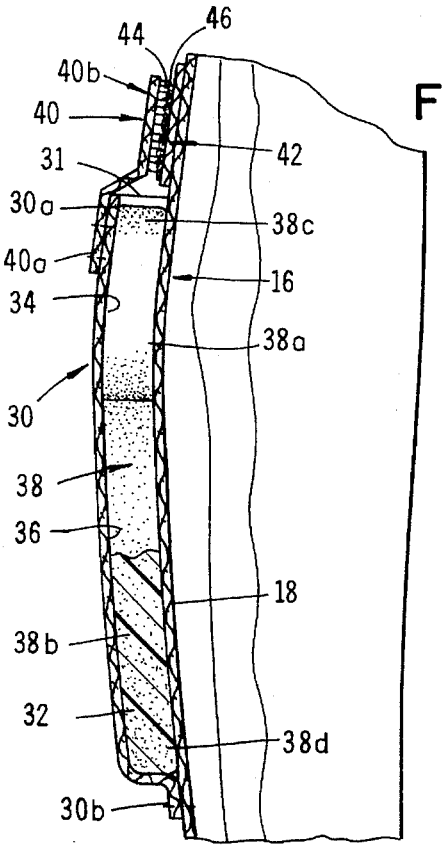
FIG. 6 is a greatly enlarged view taken along lines 6—6 of FIG. 5 and is partly broken away to show internal construction of the pocket portions.
Figure 8:
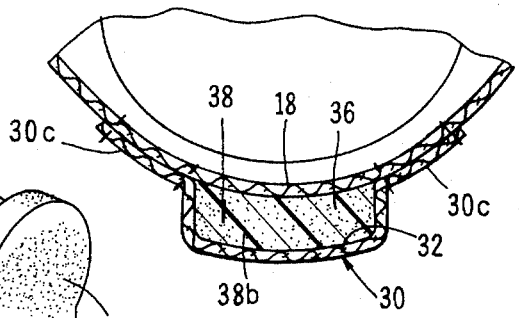
FIG. 8 is an enlarged cross-sectional view taken along lines 8—8 of FIG. 7.
Figure 9:
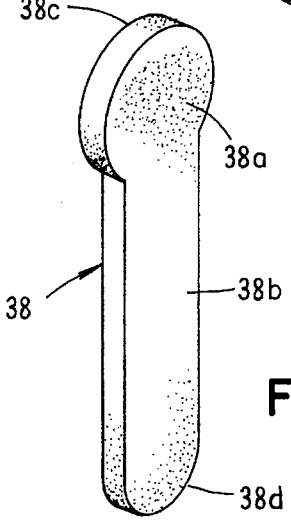
FIG. 9 is a generally perspective view of the padding component of the form of the invention shown in FIG. 5.
Figure 10:
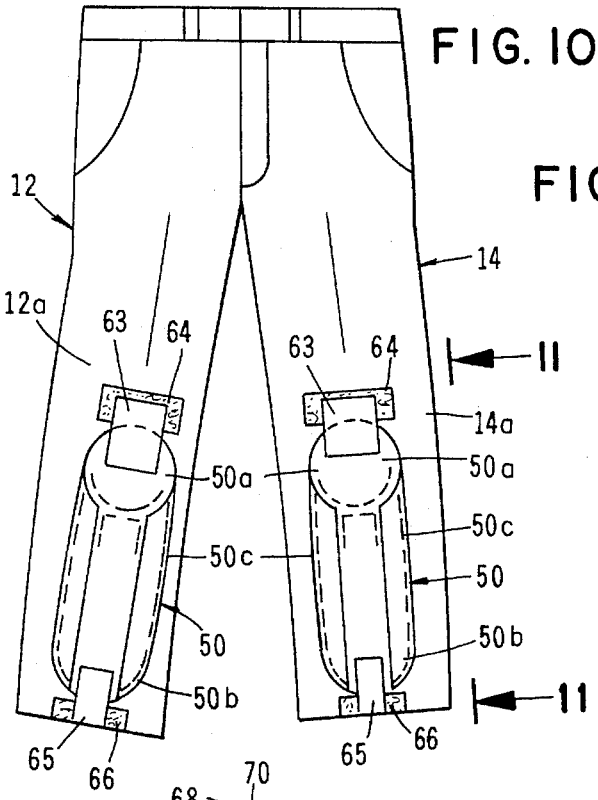
FIG. 10 is a front view of yet another embodiment of the work pants of the present invention.

A protective layer 30 is connected to the front panel of each leg and includes an upper edge 30*a* located above knee covering portion 16 and a lower edge 30*b* located below the shin covering portion 18 of the front panel. Protective covering 30 also includes opposite edge portions 30*c*. Edge portions 30*c* as well as lower edge portion 30*b* are interconnected with the front panel of each leg portion by any suitable means such as sewing to form a pocket having an interior space 32 and an upper opening 31 (FIG. 6). As best seen by referring to FIG. 7, the pocket on each leg portion comprises a first or knee compartment 34 which overlays the knee portion and a second or shin compartment 36 which overlays the shin portion of the wearer. Opening 31 provides access to both compartments.

Contained within compartments 34 and 36 is a generally keyhole shaped padding assemblage designated by the numeral 38. Padding assemblage 38 includes a knee covering portion 38*a* and shin covering portion 38*b*. Knee covering portion 38*a* is generally circular in shape having a diameter and an upper edge portion 38*c* disposed proximate the upper edge 30*a* of protective layer 30. Shin covering portion 38*b* comprises an elongated segment of lesser width than the diameter of portion 38*a*. The lower edge portion 38*d* of the assemblage is disposed proximate the lower edge 30*b* of protective layer 30.

Figure 7:
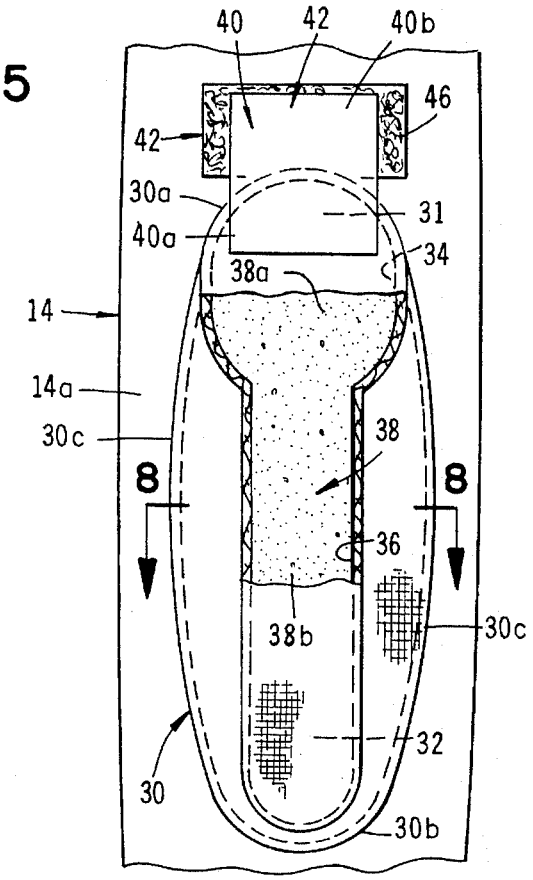
FIG. 7 is an enlarged front view of the padded area of the work pants shown in FIG. 5 partly broken away to show internal construction.

As best seen by referring to FIGS. 6 and 7, closure means are provided for releasably closing upper openings 31. This closure means here comprises for each pocket of the work pants first and second lengths of fabric 40 and 42 respectively. First length 40 has first and second end portions 40*a* and 40*b*, with first end portion 40*a* being attached proximate the upper edge 30*a* of protective layer 30 (FIG. 6) as by sewing or other suitable means. Second length of fabric 42 extends transversely of the leg portions and is connected to the front panels of the work pants as by sewing (FIG. 5). Provided proximate edge portion 40*b* of length of fabric 40 are a multiplicity of small hooks 44 which are adapted to releasably interconnect with a multiplicity of small loops 46 provided on second length of fabric 42.

With the construction described in the preceding paragraphs, and by alternately lifting and then pressing downwardly on the free end of fabric lengths 40, openings 31 can be conveniently opened and closed to permit insertion and removal of padding assemblage 38. Various hook and loop type materials can be used as the closure means, but a material sold under the name and style of VELCRO performs satisfactorily.

Figure 12:
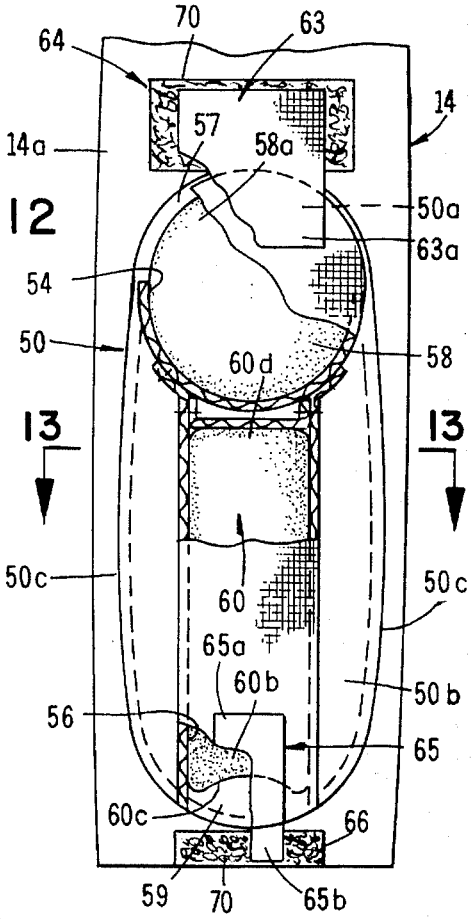
FIG. 12 is an enlarged, fragmentary, front elevational view partly broken away to show the internal construction of the padded portion of the work pants shown in FIG. 10.
Figure 13:
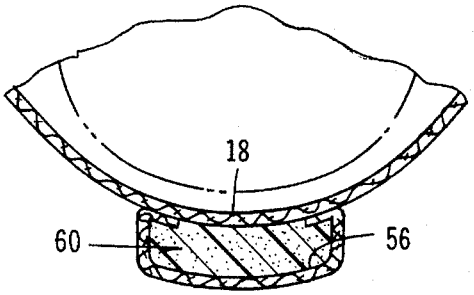
FIG. 13 is an enlarged cross-sectional view taken along lines 13—13 of FIG. 12.
Figure 14:
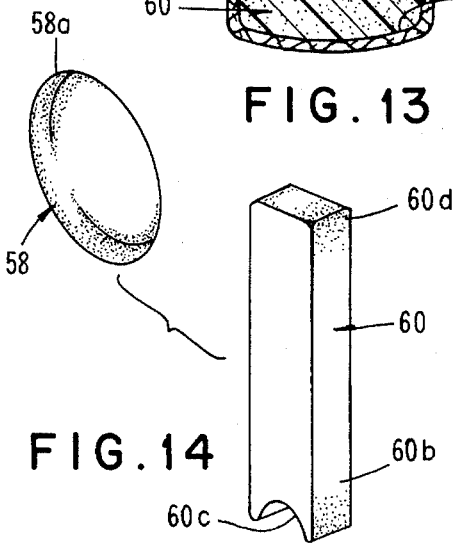
FIG. 14 is a generally perspective view of the padding components of the work pants construction illustrated in FIGS. 10, 11, and 12.

Turning now to FIGS. 12 through 14, still another form of the work pants construction of the present invention is there illustrated. This form of the invention is also similar in many respects to that shown in FIGS. 1 through 9 and, once again, like numerals have been used to identify like components. The major difference between this latest embodiment of the invention and that shown in FIGS. 6 through 14 resides in the fact that the padding assemblage here comprises two separate components. Additionally, in this latest embodiment, the knee pad component of the assemblage is removably receivable within an upper top opening pocket while the shin pad component of the assemblage is removably receivable within a lower bottom opening pocket.

As was the case in the previously described embodiment, the work pants comprise a pair of interconnected leg portions 12 and 14 each of which includes a front panel 12*a* and 14*a* respectively. Each front panel includes a knee covering portion 16 and a shin covering portion 18.

Figure 11:
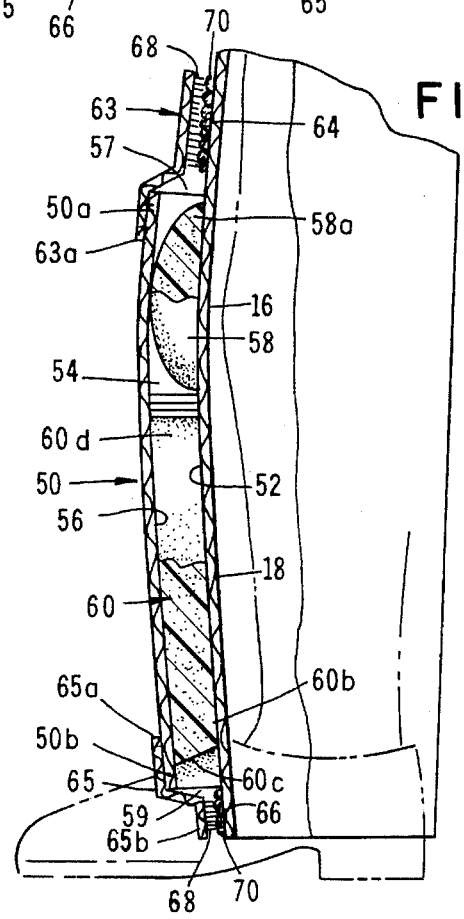
FIG. 11 is an enlarged view taken along lines 11—11 of FIG. 10 and is partly broken away to show internal construction of the pocket portions.

A protective layer 50 is connected to the front panel of each leg and includes an upper edge 50*a* located above knee covering portion 16 and a lower edge 50*b* located below the shin covering portion 18 of the front panel. Protective covering 50 also includes opposite edge portions 50*c*. Edge portions 50*c* are interconnected with the front panel of each leg portion by any suitable means such as by sewing to form a pocket having an interior space 52 and upper and lower openings 57 and 59 (FIG. 11). As best seen by referring to FIG. 11, the pocket on each leg portion comprises a first or knee compartment 54 which overlays the knee portion and a second or shin compartment 56 which overlays the shin portion of the wearer. Opening 57 provides access to compartments 54, while opening 59 provides access to compartment 56.

Contained within compartment 54 is a generally dome shaped knee padding member designated by the numeral 58. Contained within compartment 56 is an elongated shin padding member designated by the numeral 60. Knee padding member is generally circular in shape having a diameter and including an upper edge portion 58*a* disposed proximate the upper edge 50*a* of protective layer 50. As best seen in FIG. 14, shin padding member 60 comprises an elongated segment of lesser width than the diameter of member 58. The lower edge 60*b* of member 60 includes a semicircular cut-out 60*b* which is disposed proximate the lower edge 50*b* of protective layer 50. Cut-out 60*b* conveniently fits over the top of the user's foot in the manner shown in FIG. 11. With this construction, member 60 fully protects the entire shin area of the worker, but will not interfere with the normal drapping of the pants over the worker's shoes. The upper edge 60*c* of member 60 is disposed in close proximity with knee padding member 58 when both padding members are being used in the manner shown in the drawings.

As best seen by referring to FIGS. 11 and 12, closure means are provided for releasably closing upper and lower openings 57 and 59. The closure means here comprises for each pocket of the work pants first, second, third, and fourth lengths of fabric 63, 64, 65, and 66 respectively. First and third lengths 63 and 65 have first end portions 63*a* and 65*a* respectively. First end portion 63*a* of length 63 is attached proximate the upper edge 50*a* of protective layer 50 (FIG. 6) as by sewing or other suitable means. Similarly, first end portion 65*a* of length 65 is attached proximate lower edge 50*b* of protective layer 50 as by sewing or other suitable means. Second lengths of fabric 64 and 66 are connected to and extend transversely of the front panels of the work pants as by sewing in the manner shown in FIGS. 11 and 12. Provided proximate second end portions 63*b* and 65*b* of lengths of fabric 63 and 65 are a multiplicity of small hooks 68 which are adapted to releasably interconnect with a multiplicity of small loops 70 provided on second lengths of fabric 64 and 66.

With this construction, by manipulating the free ends of fabric lengths 63 and 65, openings 57 and 59 can be conveniently opened and closed to permit insertion and removal of padding components 58 and 60. Depending upon the work being performed, the worker can chose to use either or both of the padding elements as desired.

As was the case in the embodiments of the invention shown in FIGS. 5 through 9 and in FIGS. 10 through 14, the closure means can here comprise a number of commercially available lengths of connector fabric having interconnecting hooks and loops including connector fabric sold under the name and style of VELCRO

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A pair of work pants comprising:

(a) a pair of interconnected leg portions, each leg portion comprising a front panel having a knee covering portion and a shin covering portion;

(b) a protective layer connected to said front panel of each leg, each said protective layer having an upper edge located above said knee covering portion, a lower edge located below said shin covering portion and opposite edge portions, said opposite edge portions of said protective layer being interconnected with said front panels of each of said leg portions in a manner to define pockets having an upper opening and a lower opening;

(c) closure means for releasably closing said upper and lower openings; and (d) a padding mounted within each said pocket, said padding including a knee covering portion of a first width having an upper edge disposed proximate said upper edge of said protective layer and a shin covering portion of a second lesser width having a lower edge disposed proximate said lower edge of said protective layer.

2. A pair of work pants as defined in claim 1 in which said padding comprises first and second cooperating components, said first component comprising a knee pad and said second component comprising a shin pad.

3. A pair of work pants as defined in claim 2 in which said first component is removably receivable within said upper opening of said pockets and in which said second component is removably receivable within said lower opening of said pockets.

4. A pair of work pants as defined in claim 3 in which said first component is generally circularly shaped and is of a diameter generally corresponding to the width of said first opening in said pockets.

5. A pair of work pants as defined in claim 4 in which said second component comprises an elongated pad having a width substantially less than the diameter of said first component.

6. A pair of work pants as defined in claim 5 in which said elongated pad is provided with a generally semicircular shaped cut-out proximate its lower edge.

7. A pair of work pants as defined in claim 5 in which said closure means comprises first and second lengths of fabric, said first length having a multiplicity of small hooks and said second length having a multiplicity of small loops lockably receivable within said small hooks to releasably interconnect said first and second lengths of fabric.

8. A pair of work pants comprising:

(a) a pair of interconnected leg portions, each leg portion comprising a front panel having a knee covering portion and a shin covering portion;

(b) a protective layer connected to said front panel of each leg, each said protective layer having opposite edge portions, an upper edge located above said knee covering portion and a lower edge located below said shin covering portion, said protective layer being connected to the front panel of the respective leg portions in a manner to define an upper pocket having an upper opening of a first width and a lower pocket having a lower opening of a second, lesser width;

(c) closure means for releasably closing said upper and lower openings; and (d) a padding assemblage mounted within each said pocket, said padding assemblage comprising:

(i) a generally circularly shaped knee pad removably receivable within said upper pocket; and (ii) an elongated shin pad removably receivable within said lower pocket.

9. A pair of work pants as defined in claim 8 in which said knee pad is of a diameter generally corresponding to the width of said upper opening in said pockets and said shin pad is of a width generally corresponding to said width of said lower opening in said pockets.

10. A pair of work pants as defined in claim 9 in which said shin pad is provided with a generally semicircular shaped cut-out proximate its lower edge.

11. A pair of work pants as defined in claim 9 in which said closure means comprises first and second lengths of fabric, said first length having a multiplicity of small hooks and said second length having a multiplicity of small loops lockably receivable within said small hooks to releasably interconnect said first and second lengths of fabric.

12. A pair of work pants as defined in claim 9 in which said knee pad is generally dome shaped.

13. A pair of work pants as defined in claim 12 in which said knee pads and said shin pads are constructed from an elastomeric polymer.

* * * * *